US005428194A

United States Patent [19]

Emrick et al.

[11] Patent Number: 5,428,194

[45] Date of Patent: Jun. 27, 1995

[54] NARROW WIDTH STAMP FORMED MUFFLER

[75] Inventors: James W. Emrick; Jon W. Harwood, both of Toledo, Ohio

[73] Assignee: AP Parts Manufacturing Company, Toledo, Ohio

[21] Appl. No.: 138,749

[22] Filed: Oct. 19, 1993

[51] Int. Cl.[6] ..... F01N 7/08

[52] U.S. Cl. ..... 181/228; 181/265; 181/282

[58] Field of Search ..... 181/265, 268, 275, 282, 181/228, 247–252

[56] References Cited

U.S. PATENT DOCUMENTS

| | | |
|---|---|---|
| 705,357 | 7/1902 | Keating . |
| 1,110,040 | 9/1914 | Chatain . |
| 2,484,826 | 10/1949 | Harley . |
| 2,484,827 | 10/1949 | Harley . |
| 2,658,580 | 11/1953 | Trembley . |
| 2,860,722 | 11/1958 | Gerstung . |
| 2,902,109 | 9/1959 | Burgess et al. . |
| 2,943,695 | 7/1960 | Jeffords . |
| 3,125,182 | 3/1964 | Earley . |
| 3,140,755 | 7/1964 | Tranel . |
| 3,158,222 | 11/1964 | Richmond . |
| 3,176,791 | 4/1965 | Betts et al. . |
| 3,198,284 | 8/1965 | Powers . |
| 3,220,508 | 11/1965 | Nordquest et al. . |
| 3,412,825 | 11/1968 | Hall . |
| 3,638,756 | 2/1972 | Thiele . |
| 3,650,354 | 3/1972 | Gordon . |
| 3,709,320 | 1/1973 | Höllerl et al. . |
| 3,827,529 | 8/1974 | Frietzsche et al. . |
| 3,852,041 | 12/1974 | Moore et al. . |
| 4,064,962 | 12/1977 | Hunt . |
| 4,108,274 | 8/1978 | Snyder . |
| 4,109,751 | 8/1978 | Kabele . |
| 4,132,286 | 1/1979 | Hasui et al. . |
| 4,165,798 | 8/1979 | Martinez . |
| 4,396,090 | 8/1983 | Wolfhugel . |
| 4,415,059 | 11/1983 | Hayashi . |
| 4,418,790 | 12/1983 | Agnew . |
| 4,422,519 | 12/1983 | Nomura et al. . |
| 4,456,091 | 6/1984 | Blanchot . |
| 4,523,660 | 6/1985 | Gaddi . |
| 4,598,790 | 7/1986 | Uesugi et al. . |
| 4,690,245 | 9/1987 | Gregorich et al . |
| 4,700,806 | 10/1987 | Harwood . |
| 4,736,817 | 4/1988 | Harwood . |
| 4,759,423 | 7/1988 | Harwood et al. . |
| 4,760,894 | 8/1988 | Harwood et al. . |
| 4,765,437 | 8/1988 | Harwood et al. . |
| 4,809,812 | 3/1989 | Flugger . |
| 4,821,840 | 4/1989 | Harwood et al. . |
| 4,836,330 | 6/1989 | Harwood et al. . |

(List continued on next page.)

FOREIGN PATENT DOCUMENTS

| | | |
|---|---|---|
| 59-155528 | 9/1984 | Japan . |
| 59-43456 | 12/1984 | Japan . |
| 60-111011 | 6/1985 | Japan . |
| 61-108821 | 5/1986 | Japan . |
| 6114565 | 5/1986 | Japan . |
| 61-155625 | 7/1986 | Japan . |
| 632013 | 1/1950 | United Kingdom . |
| 1012463 | 12/1965 | United Kingdom . |
| 2120318 | 11/1983 | United Kingdom . |

OTHER PUBLICATIONS

NACA Report 1192–Theoretical and Experimental Investigation of Mufflers with Comments on Engine--Exhaust Muffler design by Don D. Davis, Jr. et al, 1953.

*Primary Examiner*—Khanh Dang

*Attorney, Agent, or Firm*—Anthony J. Casella; Gerald E. Hespos

[57] ABSTRACT

An exhaust muffler includes first and second internal plates formed to define channels and chambers. The plates are secured in face-to-face relationship, such that the channels define tubes. The tubes include an inlet tube, a return tube and an outlet tube each of which extends to or from a reversing chamber. A separate pipe extends through the return tube and into the outlet tube. The pipe and the return tube are dimensioned to permit a flow of exhaust gas therebetween.

22 Claims, 3 Drawing Sheets

U.S. PATENT DOCUMENTS 4,847,965 7/1989 Harwood et al. .
4,860,853 8/1989 Moring, III .
4,894,987 1/1990 Harwood et al. .
4,901,815 2/1990 Harwood et al. .
4,901,816 2/1990 Garey .
4,905,791 3/1990 Garey .
4,909,348 3/1990 Harwood et al. .
4,924,966 5/1990 Kanda et al. ..... 181/228
4,928,372 5/1990 Harwood et al. .
4,941,545 7/1990 Wilcox et al. .
5,004,069 4/1991 Van Blaircum et al. .
5,012,891 5/1991 Macaluso .
5,042,125 8/1991 Harwood et al. .
5,164,551 11/1992 Harwood et al. .
5,173,577 12/1992 Clegg et al. .
5,252,788 10/1993 Emrick et al. .

NARROW WIDTH STAMP FORMED MUFFLER

BACKGROUND OF THE INVENTION

1. Field on the Invention

The subject invention relates to an exhaust muffler for achieving an efficient flow pattern in a narrow space.

2. Description of the Prior Art

Prior art exhaust mufflers include a plurality of tubes disposed within an external shell. The external shell typically is divided into a plurality of chambers which communicate with at least selected tubes. The communication between the chambers and the tubes may be provided by perforations, louvers or cutouts in selected tubes. Other tubes may have an open end extending into a chamber to provide the necessary communication. The tubes, chambers and communication means are designed to attenuate most of the noise associated with the flowing exhaust gas without imposing excessive back pressure on the exhaust gas stream.

Tri-flow mufflers have an efficient flow pattern and are commonly used in the prior art. The prior art tri-flow muffler includes an inlet tube, a return tube and an outlet tube disposed in parallel relationship to one another. The inlet tube extends from the inlet end of the muffler to a first reversing chamber near the outlet end of the muffler. The return tube extends from the first reversing chamber to a second reversing chamber near the inlet end of the muffler. The outlet tube extends from the second reversing chamber to the outlet end of the muffler. The three parallel tubes in the typical prior art tri-flow muffler will pass through baffles which divide the prior art muffler into a plurality of chambers. Selected tubes may be perforated or louvered to enable gas communication between the tubes and the surrounding chamber. The relative dimensions of the tubes, the perforations and the chambers vary widely from one prior art tri-flow muffler to another in accordance with characteristics of the flowing exhaust gas. However, in most prior art tri-flow mufflers, the inlet tube, the return tube and the outlet tube will be of substantially the same cross-sectional dimensions to avoid unnecessary increases in back pressure.

Perforated tubes passing through expansion chambers often are not enough to attenuate all noise associated with the flowing exhaust gas, and in many cases at least one narrow range of low frequency noise will remain. These low frequency noises typically are attenuated by a tuning tube having one end communicating with the flowing exhaust gas and having the other end extending into a closed low frequency resonating chamber. The length and cross-sectional dimensions of the tuning tube and the volume of the low frequency resonating chamber are selected to attenuate a particular narrow range of low frequency noise.

Mufflers formed substantially from stamped components have been available for many years. Recent advances in stamped muffler technology have enabled acoustical tuning equal to or better than the acoustical performance of conventional mufflers. A particularly desireable and commercially acceptable stamp formed muffler is shown in U.S. Pat. No. Re. 33,370 which was reissued on Oct. 9, 1990. A very effective muffler formed substantially from stamped components and having a flow pattern resembling a conventional tri-flow muffler is shown in copending application Ser. No. 866,753, now U.S. Pat. No. 5,252,788, which was filed on Apr. 10, 1992.

Exhaust system design is complicated by the limited available space on the underside of a vehicle. In this regard, typical tri-flow mufflers have the inlet tube, the return tube and the outlet tube disposed in a common plane so that the muffler can assume a generally oval cross-section, with the major axis of the oval aligned generally horizontally on the underside of the vehicle. Although tube dimensions will vary from muffler to muffler, a typical prior art muffler may have flow tubes with an inside diameter of approximately 2.50 inches. Three such tubes have combined outside diameters in excess of eight inches. However, the tubes must be spaced from one another and spaced from the shell of the muffler to enable adequate support by the baffles. Hence, a typical prior art tri-flow muffler formed from conventional components may have a width of approximately 11.50 inches.

Stamp formed mufflers achieve several performance and manufacturing efficiencies, but normally do not enable smaller size mufflers. In particular, generally planar lands about one inch wide are defined between adjacent stamp formed tubes and between the tubes and peripheral flanges of prior art stamp formed mufflers. Hence, a prior art stamp formed tri-flow muffler also will require a width of approximately 11.50–12.00 inch. The limited space on the underside of many vehicles cannot readily accommodate prior art tri-flow mufflers of these dimensions. Hence, engineers occasionally have been forced to use a plurality of mufflers disposed in parallel or in series. Although each muffler in such an exhaust system may be smaller, the overall system is likely to be substantially more expensive. These problems may be even greater in exhaust systems having two exhaust pipes leading into a single muffler.

The back pressure referred to above affects performance of an engine. Hence, engine performance and efficiency can be improved by lowering back pressure. Larger exhaust pipes generally produce less back pressure. However, the flow tubes within a muffler generally must match the cross-sectional dimensions of the exhaust pipe leading into the muffler. Prior art mufflers with larger flow tubes necessarily would occupy a larger space envelope. Hence, attempts to improve performance by lowering back pressure have been feasible only on vehicles with sufficient space to accommodate larger prior art mufflers.

In view of the above, it is an object of the subject invention to provide an exhaust muffler that is well suited to narrow space envelopes.

Another object of the subject invention is to provide a muffler having relatively large cross-section pipes for a limited space envelope with a limited width.

A further object of the subject invention is to provide a tri-flow muffler formed substantially from stamped components.

Yet another object of the subject invention is to provide a tri-flow muffler that is well suited for relatively narrow space envelopes.

SUMMARY OF THE INVENTION

The subject invention is directed to an exhaust muffler having at least one conventional tube disposed within an array of stamp formed components. The stamp formed components include first and second internal plates that are stamped to define an array of channels. The internal plates are secured in face-to-face relationship with one another, such that the channels define an array of tubes, including a stamp formed return tube. The tubes defined by the stamp formed internal plates may further include at least one inlet to the muffler and at least one outlet from the muffler.

A conventional pipe, manufactured by roll forming or the like, is disposed within the return tube defined by the stamp formed internal plates. The outside diameter of the conventional pipe is less than the inside diameter of the stamp formed return tube. One end of the conventional pipe may communicate with either a stamp formed inlet tube of the muffler or a stamp formed outlet tube. The opposed end of the conventional pipe communicates with the stamp formed return tube. Thus, exhaust gas flow is enabled between the conventional pipe and the stamp formed return tube in which the conventional pipe is disposed. For example, exhaust gas may flow from a stamp formed inlet tube to portions of the stamp formed return tube surrounding the conventional pipe. The exhaust gas may then undergo a substantially 180° change of direction to enter one end of the conventional pipe. The opposed end of the conventional pipe may define an outlet from the muffler or may communicate with a stamp formed outlet tube. In another embodiment one end of the conventional pipe may communicate directly with a stamp formed inlet tube. The opposed end of the conventional pipe may lie within and communicate with the stamp formed return tube. The stamp formed return tube may then communicate with a stamp formed outlet tube of the muffler.

The conventional pipe may be mounted generally concentrically within the stamp formed return tube. The concentric mounting may be achieved by dimples stamp formed at selected locations in the stamp formed return tube. Alternatively, the conventional pipe may be secured in an internally tangent disposition relative to the stamp formed return tube.

The stamp formed return tube may be closed-ended, and the end of the conventional pipe may be spaced from the closed end. Thus, the closed end of the stamp formed return tube may accommodate the substantially 180° change in direction as the exhaust gas flows between the conventional pipe and the stamp formed return tube. Alternatively, the muffler may further include at least one external shell secured to a stamp formed internal plate of the muffler. In this embodiment, the stamp formed return tube may be open ended, and may enable exhaust gas to expand into the chamber defined by the external shell. Thus, exhaust gas may expand into the chamber while flowing between the conventional pipe and the stamp formed return tube.

The inside cross-sectional area defined by the stamp formed return tube may be approximately twice as great as the outside cross-sectional area defined by the conventional pipe. Thus, there will be no significant increase in back pressure as the exhaust gas flows between the stamp formed return tube and the conventional pipe disposed therein.

The incorporation of the conventional pipe in the stamp formed return tube enables significant space efficiencies for the muffler. In particular, as noted above, prior art tri-flow mufflers, of stamped or conventional design, require space transversely between each of the respective tubes. The disposition of the conventional tube within the stamp formed return tube avoids the need for a transverse space between these adjacent tubes and enables a muffler of significantly narrower width.

DETAILED DESCRIPTION OF THE PREFERRED EMBODIMENT

Figure 1:
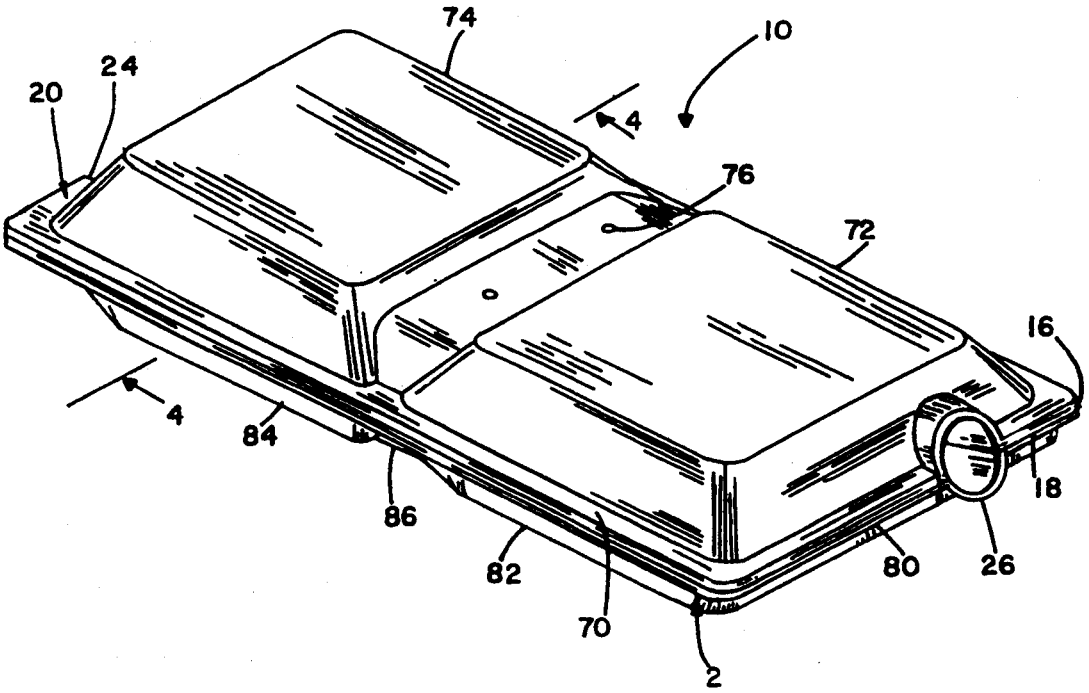
FIG. 1 is a perspective view of a muffler in accordance with the subject invention.

A muffler in accordance with the subject invention is identified generally by the numeral 10 in FIGS. 1–4. The muffler 10 is of generally rectangular shape, and includes an inlet end 12 for connecting to an exhaust pipe of a vehicular exhaust system and an opposed outlet end 14 for connecting to the tail pipe of the exhaust system. The muffler 10 includes first and second stamp formed internal plates 16 and 18 and first and second stamp formed external shells 20 and 22.

Figure 2:
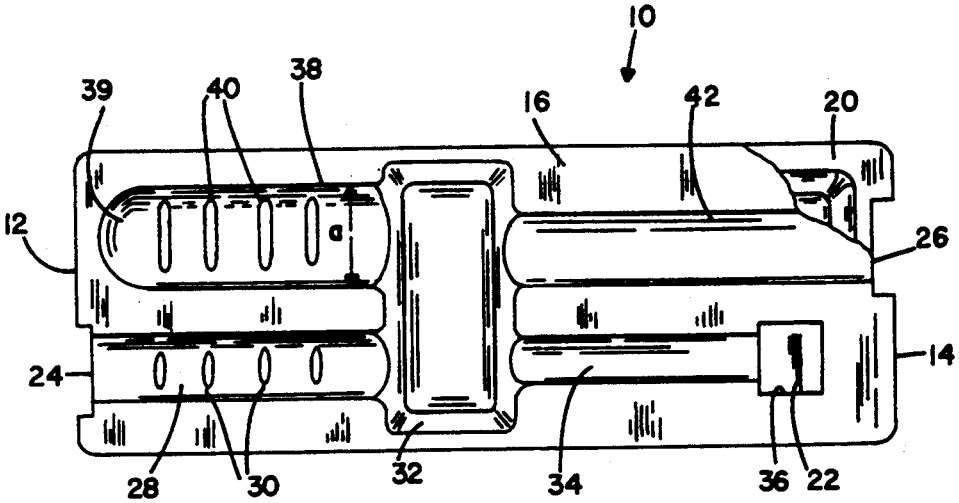
FIG. 2 is a top plan view of the muffler shown in FIG. with the top external shell depicted partly in section.

As shown most clearly in FIG. 2, the first internal plate 16 is stamped to include an array of channels and chambers which provide gas communication between an inlet 24 at the inlet end 12 of the muffler and an outlet 26 at the outlet end of the muffler 14. The channels formed in the first internal plate 16 include a louvered inlet channel 28 which extends from the inlet end 12 of the muffler toward the outlet end 14. Louvers 30 permit expansion of exhaust gas from the inlet channel 28 to a chamber defined by the external shell 20, as explained further herein. A reversing chamber 32 is defined approximately midway between the inlet and outlet ends 12 and 14 and communicates with the inlet channel 28. A tuning channel 34 extends from the reversing chamber 32 toward the outlet end 14 and generally aligned with the inlet channel 28. The tuning channel 34 terminates at a tuning aperture 36 which provides communication with a low frequency resonating chamber as described further herein. A return channel 38 with louvers 40 extend from the reversing chamber 32 back toward the inlet end 12 of the muffler 10. The louvers 30 and 40 in the inlet channel 28 and the reversing channel 36 respectively enable expansion of exhaust gas into an expansion chamber defined by the first internal plate 16 and the first external shell 20 and further enables a cross-flow of exhaust gas directly from the inlet channel 28 and the return tube 36. Return channel 38 is generally semicylindrical with an inside diameter "a" and terminates at an arcuate closed end 39. An outlet channel 42 extends from the reversing chamber 32 to the outlet end 14 of the muffler 10.

Figure 3:
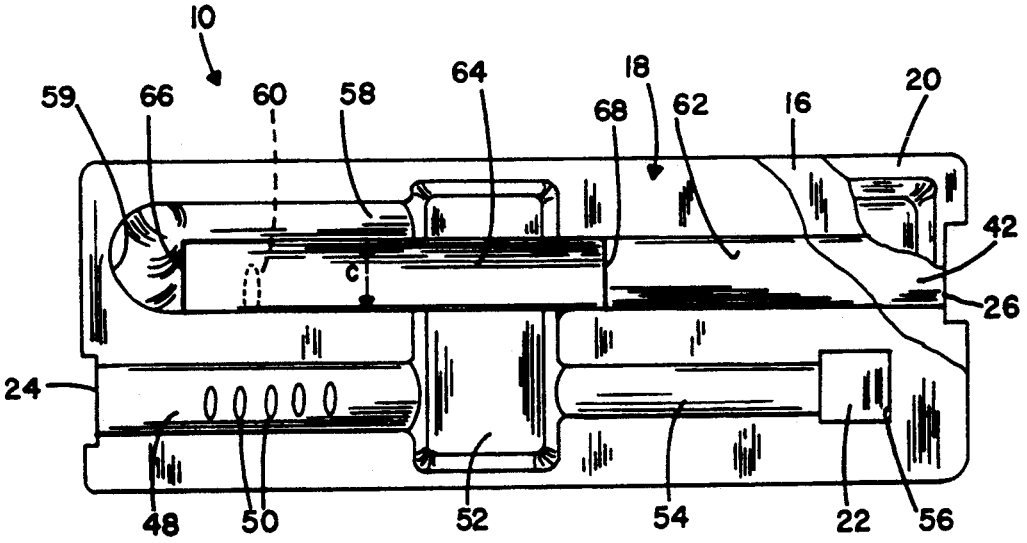
FIG. 3 is a top plan view similar to FIG. 2, but with portions of both the top external shell and the top internal plate shown in section.
Figure 4:
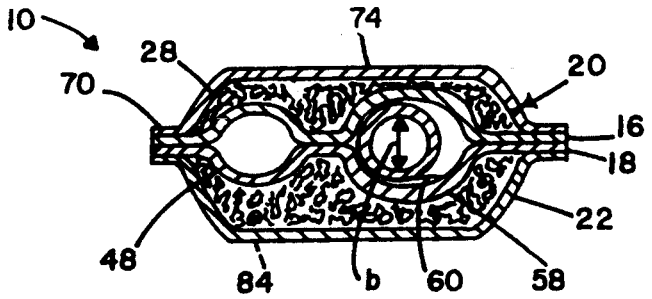
FIG. 4 is a cross-sectional view taken along line 4—4 in FIG. 1.

Turning to FIG. 3, the second internal plate 18 includes an array of channels and chambers disposed to register with the channels and chambers formed in the first internal plate 16. More particularly, the second internal plate 18 includes a louvered inlet channel 48 which extends from the inlet end 12 toward the outlet end 14 of the muffler 10. The inlet channel 48 includes an array of louvers 50 which enable expansion of exhaust gas into a chamber defined by the second external shell 22 as explained further herein. A reversing chamber 52 is disposed intermediate the opposed ends 12 and 14 of the muffler 10 and communicates with the inlet channel 48. A tuning channel 54 communicates with the reversing chamber 52 at a location aligned with the inlet channel 48. The tuning channel 54 extends from the chamber 52 toward the outlet end 14 of the muffler and terminates at a tuning aperture 56. A reversing channel 58 extends from the chamber 52 back toward the inlet end 12 of the muffler 10. The reversing channel 58 is of generally semi-cylindrical shape and terminates at an arcuate closed end 59. In the embodiment depicted herein, the reversing channel 58 has no gas communication means comparable to the louvers 40 in the first internal plate 16. However, the reversing channel 58 includes an inwardly extending support dimple 60 intermediate its length as shown in FIGS. 3 and 4. An outlet channel 62 extends from the reversing chamber 52 to the outlet 26 at the outlet end 14 of the muffler 10.

The muffler 10 further includes a conventional pipe 64 having upstream and downstream ends 66 and 68 respectively. The upstream end 66 of the pipe 64 is mounted on the support dimple 60 in the reversing channel 58 and is spaced from the arcuate closed upstream ends 39, 59 of the reversing channels 38, 58. The downstream end 68 of the pipe 64 is closely engaged by portions of the outlet channels 42, 62 adjacent the reversing chamber 32, 52. The pipe 64 defines an inside diameter "b" and an outside diameter "c". The outside diameter "c" is significantly less than the inside diameter "a" defined by the return channels 38 and 58. More particularly, the area defined by the inside diameter "b" of the conventional pipe 64 is approximately equal to the cross-sectional area defined by the inside diameter "a" of the return channels 38 and 58 minus the cross-sectional area defined by the outside diameter "c" of the pipe 64 (i.e., $\rho b^2/4=\rho a^2/4-\rho c^2/4$). As explained further herein, exhaust gas entering the return tube defined by the channels 38 and 58 will reverse direction at the closed end 39, 59 of the return channels 38, 58 and will enter the upstream end 66 of conventional pipe 64. Exhaust gas will then continue through the tube 64 and into the outlet tube 42, 62.

The first external shell 20 of the muffler 10 is stamp formed to include a peripheral flange 70. A low frequency resonating chamber 72 and an expansion chamber 74 extend from the peripheral flange 70 and are separated from one another by a connecting region 76. The connecting region 76 is disposed and configured to engage the reversing chamber 32. Thus, the reversing chamber 32 cooperates with the connecting portion 76 to separate the low frequency resonating chamber 72 from the expansion chamber 74. The low frequency resonating chamber 72 will communicate with the tuning tube defined by channels 34 and 54. The expansion chamber 74 will communicate with both the inlet channel 28 and the return channel 38. More particularly, exhaust gas in the inlet channel 28 can expand through louvers 30 into the expansion chamber 74. Similarly, exhaust gas flowing through the return channel 38 can expand through louvers 40. As depicted in FIG. 4, portions of the expansion chamber 74 surrounding the louvers 30, 40 may be packed with sound absorbing material.

The second external shell 22 is configured substantially similar to the first external shell 20. More particularly, the second external shell 22 includes a peripheral flange 80 configured for mating in face-to-face relationship with peripheral portions of the second internal plate 18. A low frequency resonating chamber 82 and an expansion chamber 84 extend from the peripheral flange 80 and are separated from one another by a connecting portion 86. The tuning tube 34, 54 communicates with the low frequency resonating chamber 82 through the tuning aperture 56 in the second internal plate 18. The expansion chamber 84 communicates with the inlet tube 28, 48 through the louvers 50. As shown in FIG. 4, glass insulation may be packed in expansion chamber 84.

The muffler 10 is assembled by first positioning the pipe 64 to extend between the support 60 and the outlet channel 62. The pipe 64 may be welded in the internal tangent position depicted in FIG. 3. The first internal plate 16 is then secured over the second internal plate 18, and may be welded at selected locations thereabout. The external shells 20 and 22 are then secured around the internal plates 16 and 18, and the peripheral flanges 70, 80 are securely connected to adjacent peripheral regions of the internal plates 16 and 18.

As noted above, prior art tri-flow mufflers generally require about one inch between adjacent tubes and some distance between the tubes and the adjacent sides of the muffler. The muffler 10 has one less tube than prior art tri-flow mufflers, and thus saves one-inch across the width of the muffler 10. Additionally, the area between the return tube 38, 58 and the pipe 64 can be made equal to the internal area of the pipe 64 by having an internal diameter "a" for the stamp formed return tube 38, 58 that can be significantly less than the combined internal diameters for two separate pipes. For example, if the inside diameter "b" of the pipe 64 equals 2.25 inch and the outside diameter "c" of the pipe 64 equals 2.32 inch, the return tube 38, 58 can be made with an inside diameter of approximately 3.23 inch and an outside diameter of about 3.30 to have the area between the pipe 64 and the return tube 38, 58 equal the internal area of the pipe 64. This 3.30 inch outside diameter for the return tube 38, 58 is 1.34 inch less than the 4.64 inches that would be required for two 2.32 O.D. tubes in the prior art. As a result of the one less tube and the more efficient disposition of tubes, the muffler 10 is approximately 2.34 inches narrower than a typical prior art tri-flow pipe.

Figure 5:
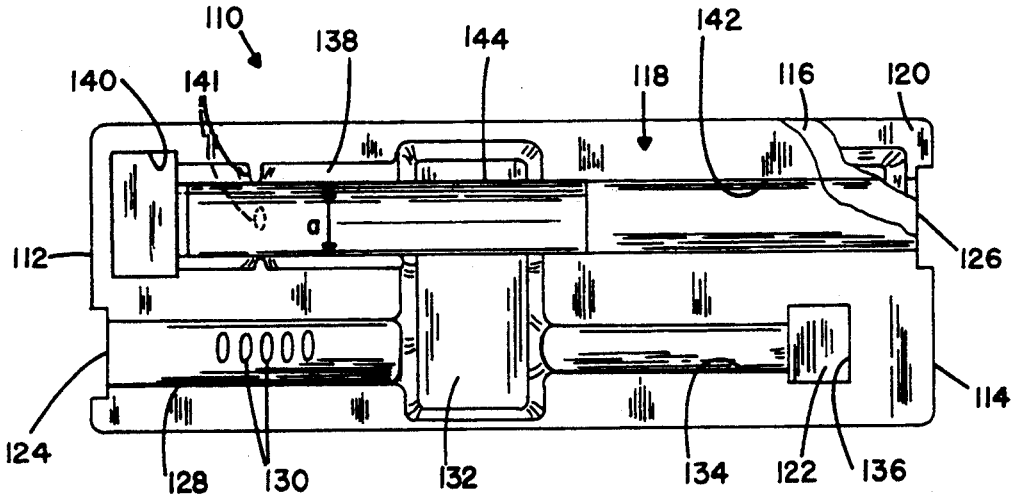
FIG. 5 is a top plan view, partly in section, similar to FIG. 3, but showing a second embodiment.

FIGS. 5 shows an alternate muffler 110. The muffler 110 includes an inlet end 112 and an outlet end 114 and is defined in part by first and second internal plates 116 and 118 and first and second external shells 120 and 122. For simplicity, the first internal plate 116 and the first external shell 120 will be assumed to be exact mere images of one another. However, such symmetry is not required.

The second internal plate 118 includes an inlet channel 128 having louvers 130 formed therethrough to permit expansion of exhaust gas into an expansion chamber defined by the second external shell 122. The inlet channel 128 extends to a reversing channel 132 which is disposed intermediate the opposed inlet and outlet ends 112 and 114 of the muffler 110.

A tuning channel 134 extends from the reversing chamber 132 at a location generally in line with the inlet channel 128. The tuning channel 134 ends in a tuning aperture 136 which enables communication with a low frequency resonating chamber defined by the second external shell 122. A return channel 138 extends from the reversing chamber 132 to an expansion aperture 140 in proximity to the inlet end 112 of the muffler. The return channel 138 defines an inside diameter "a" along most of its length. However, support dimples 141 are disposed along the length of the return channel 138. An outlet channel 142 extends from the reversing chamber 132 to the outlet end 114 of the muffler. A conventional pipe 144 is mounted between the first and second internal plates 116 and 118 and extends from a location generally in line with the expansion aperture 140 to the outlet channel 142. As shown most clearly in FIG. 5, the conventional pipe 144 is mounted concentrically within return channel 138 on the support dimples 141.

The muffler 110 is similar to the muffler 10 in that it provides a tri-flow muffler within a narrow width. More particularly, exhaust gas enters the inlet 124 of the muffler 110 and flows through the inlet tube 128 and into the reversing chamber 132. The exhaust gas then undergoes a substantially 180° change in direction and flows through the annular space between the reversing tube 138 and the conventional pipe 144. The exhaust gas will expand through the expansion apertures 140 and into the expansion chamber defined by the external shells 120 and 122. The exhaust gas will then undergo a second 180° change in direction, and will flow through the conventional pipe 144 and into the outlet tube 142 defined by the stamp formed internal plates 116 and 118.

Figure 6:
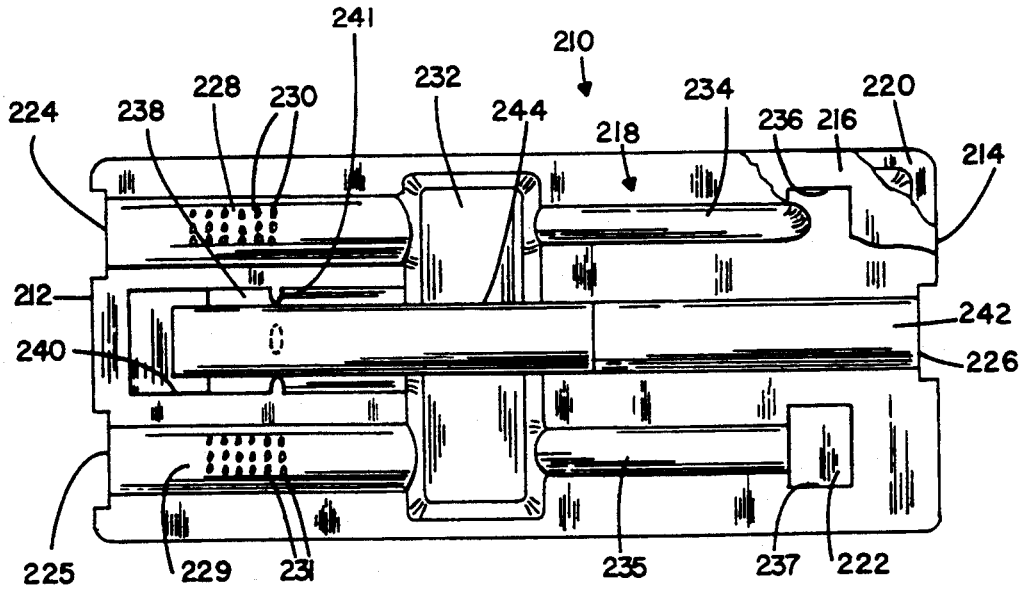
FIG. 6 is a top plan view, partly in section, similar to FIGS. 3 and 5, but showing a third embodiment.

FIG. 6 shows a narrow tri-flow muffler 210 with two inlets for receiving two separate exhaust pipes. More particularly, the muffler 210 includes an inlet end 212 and an outlet end 214. The muffler 210 is formed from first and second stamp formed internal plates 216 and 218 and first and second stamp formed external shells 220 and 222. The internal plates and the external shells of the muffler 210 are stamp formed to define first and second inlets 224 and 225 to the muffler 210 and a single outlet 226. The internal plates 216 and 218 are stamp formed to include first and second inlet tubes 228 and 229, each of which includes an array of perforations 230, 231. The inlet tubes 228, 229 extend to a reversing chamber 232. First and second tuning tubes 234 and 235 extend from the reversing chamber 232 at locations generally in line with the inlet tubes 228 and 229. The tuning tube 234 includes a tuning aperture 236 which extends through the first internal plate 216 to enable communication with a low frequency resonating chamber defined by the first external shell 220. The second tuning tube 235 terminates at a tuning aperture 237 in the second internal plate 218 to enable communication with a low frequency resonating chamber defined by the second external shell 222. The tuning tubes 234 and 235 are disposed in opposed relationship to the inlets 228 and 229 to achieve an effective driven tuning. A return tube 238 extends from the reversing chamber 232 to an expansion aperture 240. The return tube 238 further includes support dimples 241 stamp formed therein. An outlet tube 242 extends from the reversing chamber 232 to the outlet 226 at the outlet end 214 of the muffler 210. A conventional pipe 244 is supported on the dimples 241 in the return tube 238 and extends to the outlet tube 242.

Exhaust gas will enter the two inlet tubes 228, 229 of the muffler 210, and will flow into the reversing chamber 232. The exhaust gas will continue from the reversing chamber 232 through the annular space of the return tube 238 surrounding the conventional pipe 244 and back toward the inlet end 212 of the muffler 210. The exhaust gas will expand through the expansion aperture 240 and through the perforations 230,231. This expansion will contribute to the attenuation of exhaust noise. Gas will then flow through the conventional pipe 244 and into the outlet tube 242.

The muffler 210 depicted in FIG. 6 achieves a tri-flow pattern for a system having two exhaust pipes leading into a single muffler. As in the previous embodiments, the tri-flow pattern is enabled in a relatively small space for a muffler with two inlets. The muffler 210 also achieves the desireable feature of having a tuning tube driven for each inlet.

While the invention has been described with respect to certain preferred embodiments, it is apparent that various changes can be made without departing from the scope of the invention as defined by the appended claims. For example, although the depicted mufflers have two internal plates and two external shells, a muffler with fewer than two external shells may be appropriate for some embodiments. Additionally, other flow patterns and/or other means for achieving expansion of exhaust gas may be employed. These and other changes will be apparent to a person skilled in the art after having read the subject disclosure.

What is claimed is:

1. An exhaust muffler comprising first and second plates secured in face-to-face relationship and formed to define an array of tubes and at least one chamber, said tubes comprising at least one inlet extending from a first peripheral location of said muffler into said chamber, a return tube extending from said chamber and an outlet tube extending from said chamber to a second peripheral location on said muffler, said return tube defining a selected internal cross-sectional area, said muffler further comprising a pipe having opposed upstream and downstream ends, and defining an external cross-sectional area less than the internal cross-sectional area of said return tube, said pipe being secured between said plates with said upstream end disposed in said return tube and said downstream end being disposed in said outlet tube, said cross-sectional areas of pipe and said return tube permitting a flow of exhaust gas from said chamber through portions of said return tube surrounding said pipe and into said upstream end of said pipe.

2. An exhaust muffler as in claim 1, wherein said return tube has a closed end remote from said chamber and wherein the upstream end of said pipe is spaced from said closed end of said return tube.

3. An exhaust muffler as in claim 1, wherein said pipe is supported substantially concentrically within said return tube.

4. An exhaust muffler as in claim 1, wherein said pipe is secured in an internally tangential relationship is said return tube.

5. An exhaust muffler as in claim 1, wherein said downstream end of said pipe is tightly engaged by said outlet tube.

6. An exhaust muffler as in claim 1, further comprising at least one external shell enclosing at least one of said first and second internal plates, at least one said tube having perforation means formed therethrough for permitting communication with the external shell.

7. An exhaust muffler as in claim 6, wherein at least one said internal plate includes an expansion aperture formed therethrough and communicating with said return tube at a location remote from said chamber, such that exhaust gas flowing between said return tube and said pipe expands into said external shell before entering upstream end of said pipe.

8. An exhaust muffler as in claim 1, wherein portions of said return tube surrounding said pipe define a cross-sectional area approximately equal to a cross-sectional area defined within said pipe.

9. An exhaust muffler as in claim 1, further comprising at least one tuning tube extending from said chamber.

10. An exhaust muffler as in claim 1, comprising two inlet tubes extending from spaced apart peripheral locations on said muffler into said chamber.

11. An exhaust muffler having opposed inlet and outlet ends and comprising first and second plates secured in face-to-face relationship and formed to define an array of tubes and a reversing chamber and comprising first and second external shells having peripheral flanges secured respectively to said first and second internal plates, said external shells being formed to define at least one chamber surrounding said tubes and said reversing chamber of said internal plates, said tubes defined by said internal plates comprising an inlet tube extending from said inlet end of said muffler to said reversing chamber, a return tube extending from said reversing chamber toward said inlet end of said muffler, said return tube defining an internal cross-sectional area, an outlet tube extending from said reversing chamber to said outlet end of said muffler, said outlet tube being generally aligned with said return tube, said muffler further comprising a pipe having opposed upstream and downstream ends and defining an external cross-sectional area less than the internal cross-sectional area of said return tube, said pipe being secured between said plates with said upstream end disposed in said return tube and said downstream end disposed in said outlet tube, said cross-sectional areas of said pipe and said return tube permitting a flow of exhaust gas from said chamber, through portions of said return tube surrounding said pipe and into said upstream end of said pipe for flow to the outlet tube of said muffler.

12. An exhaust muffler as in claim 11, wherein said return tube includes a plurality of inwardly extending dimples for supporting said pipe in substantially concentric relationship therein.

13. An exhaust muffler as in claim 11, wherein said pipe is secured in an internally tangential relationship in said return tube.

14. An exhaust muffler as in claim 11, wherein said downstream end of said pipe is securely engaged in face-to-face relationship with said outlet tube for preventing direct flow of exhaust gas from said reversing chamber to said outlet tube.

15. An exhaust muffler as in claim 11, wherein said return tube includes a closed end, said upstream end of said pipe being spaced from said closed end for permitting flow of exhaust gas from said return tube into said upstream end of said pipe.

16. An exhaust muffler as in claim 11, wherein portions of said return tube remote from said chamber include an expansion aperture for permitting expansion of exhaust gas from said return tube into chambers defined by said external shells.

17. An exhaust muffler as in claim 11, wherein said pipe includes internal and external cross-sectional areas and wherein said return tube defines an internal cross-sectional area, said internal cross-sectional area of said pipe being approximately equal to the internal cross-sectional area of said return tube minus the external cross-sectional area of said pipe.

18. An exhaust muffler as in claim 11, further comprising at least one tuning tube extending from said chamber.

19. An exhaust muffler having an inlet for receiving an in-flow of exhaust gas and an outlet for permitting an out-flow of exhaust gas, said muffler comprising first and second plates secured in face-to-face relationship and formed to define at least one tube having a selected internal cross-sectional area and opposed first and second ends, said muffler further comprising a pipe having opposed first and second ends and an external cross-sectional area less than the internal cross-sectional area of said tube, at least said first end of said pipe being secured between said formed plates at a location intermediate the first and second ends of said tube, the second end of said pipe projecting beyond the second end of said tube, said pipe and said tube being disposed in said muffler such that exhaust gas flows in a first direction through portions of said tube surrounding said pipe, undergoes a substantially 180° change of direction between the first end of said pipe and the first end of said tube, and flows in an opposed direction through said pipe.

20. An exhaust muffler as in claim 19, wherein said first end of said tube is closed.

21. An exhaust muffler as in claim 19, further comprising an external shell defining at least one chamber surrounding said plates, said first end of said tube being opened and communicating with said chamber defined by said external shell.

22. An exhaust muffler as in claim 19, wherein said second end of said tube communicates with the inlet and wherein the second end of the pipe communicates with the outlet.

* * * * *